US005103987A

United States Patent [19]

Davis

[11] Patent Number: 5,103,987

[45] Date of Patent: Apr. 14, 1992

[54] SHELF ENGAGING BOOKEND

[76] Inventor: John C. Davis, 1693 Menlo Rd., Fort Myers, Fla. 33901

[21] Appl. No.: 660,540

[22] Filed: Feb. 25, 1991

[51] Int. Cl.[5] ..... A47F 7/00

[52] U.S. Cl. ..... 211/43; 211/184

[58] Field of Search ..... 211/43, 184; 108/61

[56] References Cited

U.S. PATENT DOCUMENTS

| | | | |
|---|---|---|---|
| 679,474 | 7/1901 | Early | 211/184 X |
| 799,371 | 9/1905 | Eustis | 211/43 X |
| 1,322,791 | 11/1919 | Hormes | 211/184 X |
| 1,663,432 | 3/1928 | Ames | 211/43 X |
| 1,768,379 | 6/1930 | Smith | 211/43 X |
| 3,173,708 | 3/1965 | Machielse et al. | 211/184 X |
| 3,601,258 | 8/1971 | Stein | 211/184 |
| 3,739,918 | 6/1973 | Kreitzburg | 211/184 X |
| 3,780,873 | 12/1973 | Silva | 211/184 X |
| 4,327,838 | 5/1982 | Cooke | 211/184 |
| 4,782,960 | 11/1988 | Mavrakis | 211/184 |

FOREIGN PATENT DOCUMENTS

| | | | |
|---|---|---|---|
| 0070528 | 1/1950 | Denmark | 211/43 |
| 2910766 | 10/1980 | Fed. Rep. of Germany | 211/43 |

*Primary Examiner*—Alvin C. Chin-Shue
*Assistant Examiner*—Sarah A. Lechok
*Attorney, Agent, or Firm*—William E. Noonan

[57] ABSTRACT

A bookend is disclosed for a bookshelf having top and bottom surfaces and a forward edge, which top surface supports a row of books in an upright condition with the bound edges of the books facing forwardly. The bookend includes a shelf engaging section having a first engagement portion for engaging the top surface of the bookshelf adjacent to the row of books, a second engagement portion for engaging the bottom surface of the bookshelf underneath the row of books and a first intermediate portion that extends across the forward edge of the bookshelf for interconnecting the first and second engagement portions. There is a bookstop section attached to and extending upwardly from shelf engaging section for engaging the book at the end of the row of books.

20 Claims, 3 Drawing Sheets

SHELF ENGAGING BOOKEND

FIELD OF THE INVENTION

This invention relates to a bookend that is releasably engaged with a bookshelf at an end of a row of books.

BACKGROUND OF THE INVENTION

Many types of bookends are used to support a row of books on a shelf, desk or similar surface. A commonly employed device features a horizontal plate that sits on the top of the shelf and slides under one end of the row of books. A second vertical plate extends upwardly from the horizontal plate to engage the book at the end of the row. This apparatus is typically quite unstable. It tends to wobble and tip, particularly when supporting a row of heavy or oversized books. Moreover, such bookends tend to slide around on the bookshelf. This can scratch or otherwise damage the shelf and the books.

Various bookends have been developed that attach to, or otherwise positively engage the bookshelf. Again, however, these devices usually provide relatively unstable support. Conventional bookends, such as are disclosed by Cooke, U.S. Pat. No. 4,327,838 and Knudsen, Danish Patent No. 70,528, are constructed so that when mounted to the bookshelf they are disposed generally in a single vertical plane beside the row of books. As a result, these bookends tend to wobble or twist on the shelf under the load of a row of books. They are also limited as to the thickness of the shelf they can accommodate. To remedy this problem, certain systems employ elaborate bookend clamps and specially constructed shelves. However, such products are often bulky, unwieldy and unattractive. Moreover, typically, they cannot be conveniently adapted to a standard bookshelf. These intricate bookends also tend to require fairly complex and expensive manufacturing techniques.

SUMMARY OF THE INVENTION

It is therefore an object of this invention to provide a bookend that securely and stably engages the bookshelf to support a row of books on the shelf.

It is a further object of this invention to provide a bookend that supports even heavy and oversized books without twisting, tipping or sliding on the bookshelf.

It is a further object of this invention to provide a bookend that provides reliable support without damaging the bookshelf or the books.

It is a further object of this invention to provide a bookend that employs a relatively simple construction and that does not require intricate clamps or specifically constructed shelves for its operation.

This invention results from a realization that improved bookend support may be achieved by employing a generally perpendicular bookend configuration that includes a first elongate rod for engaging the top surface of the bookshelf adjacent a row of books, a second elongate rod for engaging the bottom surface of the bookshelf underneath the books and a third engagement rod for engaging one end of the stack of books. Such a bookend exerts sufficient leverage against both the top and bottom surfaces of the bookshelf and the stack of books so that adequate support is maintained.

This invention features a bookend for a bookshelf having top and bottom surfaces and a forward edge. The top surface of the bookshelf supports a row of books in an upright condition with the bound edges of the books facing forwardly. The bookend includes a shelf engaging section having a first engagement portion for engaging the top surface of the bookshelf adjacent to the row of books, a second engagement portion for engaging the bottom surface of the bookshelf underneath the row of books and a first intermediate portion that extends across the forward edge of the bookshelf for interconnecting the upper and lower portions. There is a bookstop section that is attached to and extends generally upwardly from the shelf engaging section for engaging the book at the end of the row of books.

In a preferred embodiment, the book stop section includes a third engagement portion that engages the book at the end of the row and a second intermediate portion that interconnects the first and second engagement portions and supports the third engagement portion above the bookshelf. Preferably, the first, second and third engagement portions include first, second and third rod segments, respectively, the first intermediate portion includes a fourth rod segment integrally interconnecting the first and second rod segments, and the second intermediate portion includes a fifth rod segment integrally interconnecting the first and third rod segments. The rod segments may be connected in an end to end arrangement. The first engagement portion may further include a slip-resistent sleeve mounted on the first rod segment for defining an outer surface of the first engagement portion. The second and third engagement portions may also include respective slip-resistent sleeves mounted on the second and third rod segments, respectively.

Each rod segment may form a right angle with each other rod segment to which it is connected. The first, second and third rod segments are preferably disposed generally parallel to one another. The fourth and fifth rod segments are preferably disposed generally perpendicular to one another. The first, second and third rod segments may have generally equal lengths. The fourth and fifth rod segments may have either equal or unequal lengths.

The shelf engaging section may be disposed generally in a first plane and the bookstop section may be disposed generally in a second plane that is generally perpendicular to the first plane. More particularly, the first, second and fourth rod segments may be disposed generally in a first plane and the third and fifth rod segments may be disposed generally in a second plane that is generally perpendicular to the first plane.

DETAILED DESCRIPTION OF PREFERRED EMBODIMENT

Other objects, features and advantages will occur from the following description of a preferred embodiment and the accompanying drawings, in which.

Figure 1:
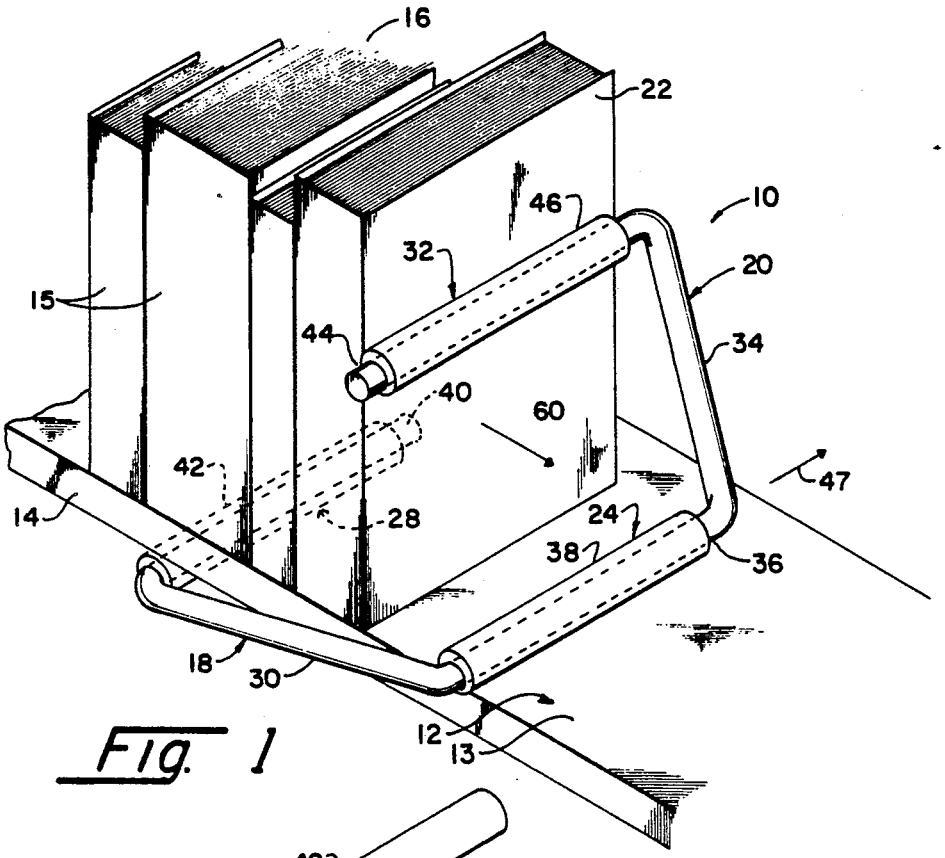
FIG. 1 is a perspective view of a righthand bookend according to this invention mounted to a bookshelf at one end of a row of books.

There is shown in FIG. 1 a shelf engaging bookend 10 that is mounted to a conventional, generally planar bookshelf 12 having an upper surface 13 and a forward edge 14. Bookend 10 supports one end (the righthand end) of a row of books 16 that are arranged on the upper shelf surface 13 with their bindings 15 facing forwardly.

Bookend 10 includes a lower shelf engaging section 18 that engages bookshelf 12 and a upper bookstop section 20 that is attached and extends upwardly from section 18 for engaging the book 22 at the end of row 16. Section 18 includes a first engagement portion 24 that engages upper shelf surface 13 adjacent row 16 and a second engagement portion 28 that engages the bottom surface of bookshelf 12 underneath the row of books. An intermediate portion 30 interconnects portions 24 and 28 and extends across forward edge 14. Bookstop section 20 includes a third engagement portion 32 that extends across and engages book 22 and a second intermediate portion 34 that interconnects portions 24 and 32.

More particularly, first engagement portion 24 includes an elongate rod segment 36 and an elongate slip-resistent sleeve 38 that is mounted on segment 36. Similarly, second engagement portion 28 includes a second rod segment 40 and a second slip-resistent sleeve 42 that is mounted on rod 40. Third engagement portion 32 likewise includes an elongate rod segment 44 and a slip-resistent sleeve 46 that is mounted thereon. Intermediate portions 30 and 34 comprise respective rod segments. Intermediate rod segment 30 integrally interconnects rod segments 36 and 40 and extends across the forward edge 14 of bookshelf 12. Intermediate rod segment 34 similarly integrally interconnects the opposite end of rod segment 36 and rod segment 44, and serves to support third engagement portion 32 above the upper surface 13 of bookshelf 12.

Figure 2:
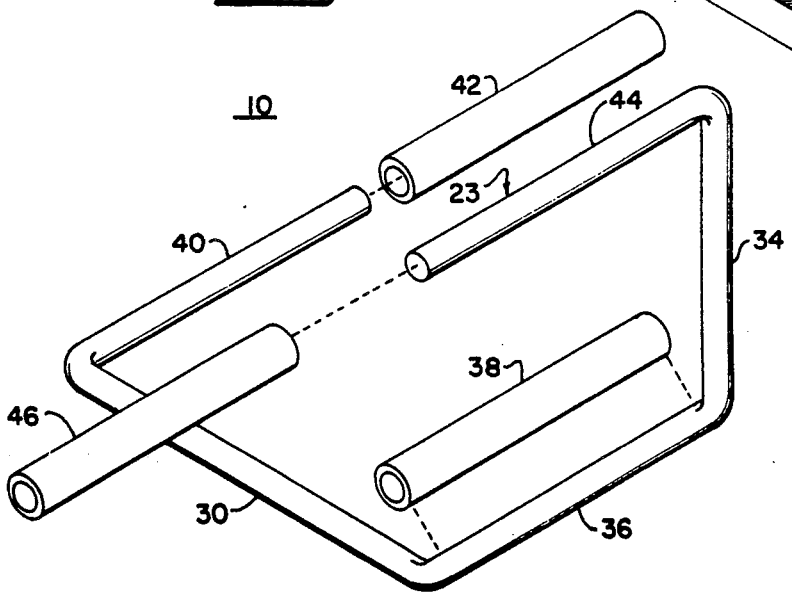
FIG. 2 is a perspective, exploded view of the bookend of FIG. 1.

As shown most clearly in FIG. 2, the rod segments 30, 34, 36, 40 and 44 are integrally interconnected in an end to end fashion to form a one piece rod member 23 having a generally serpentine shape. The rod members may be composed of various materials, although a sturdy and somewhat flexible, lightweight metal, metal alloy or plastic is preferred. Each of the sleeves 38, 42 and 46 is composed of a suitable slip-resistent material such as a rubber, plastic or an alternative elastomer. Sleeve 38 is fitted onto rod segment 36 prior to the attachment of at least one of the other sleeves and is manipulated along rod member 23 from one end thereof until it is disposed on rod segment 36, as shown in FIG. 1. The other sleeves 42 and 46 are then simply slipped onto respective rod segments 40 and 44 from the distal ends thereof. Various other techniques may also be employed to attach the slip resistant sleeves to rod 23.

Figure 3:
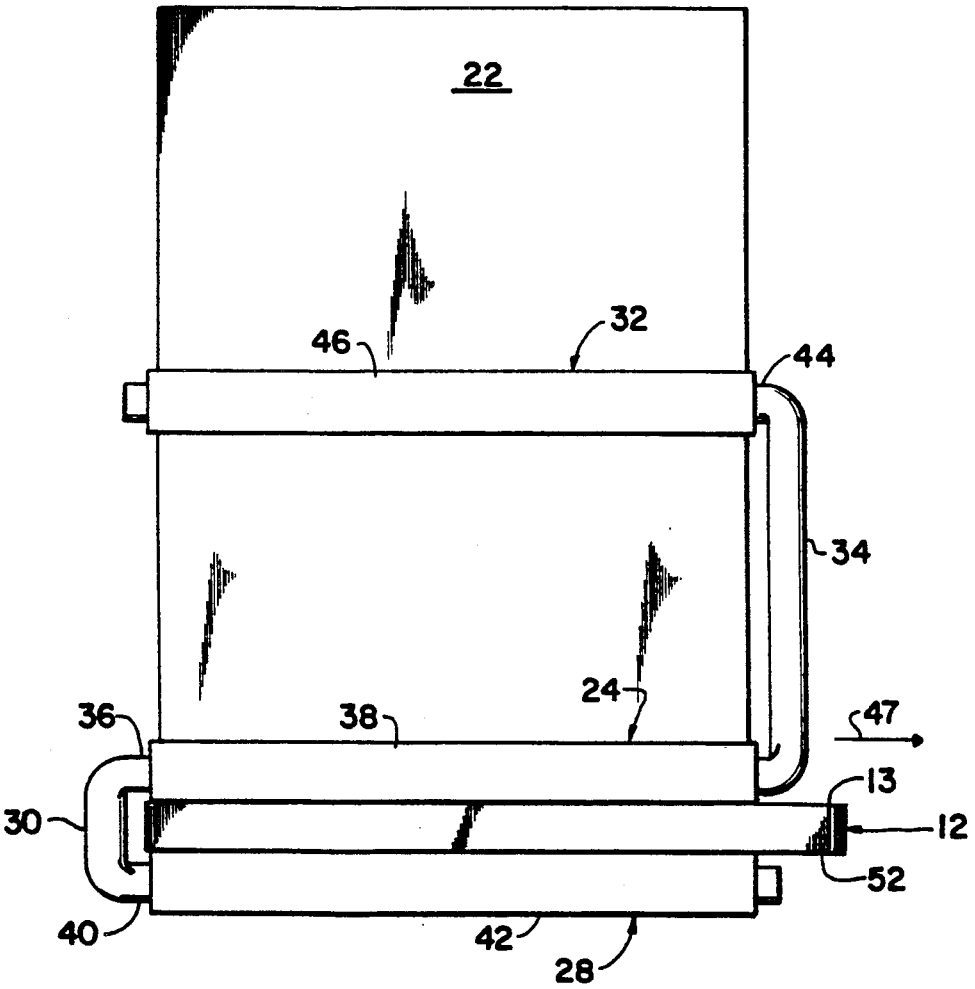
FIG. 3 is a side elevational view of the bookend of FIG. 1 mounted to the bookshelf and supporting a row of books.
Figure 4:
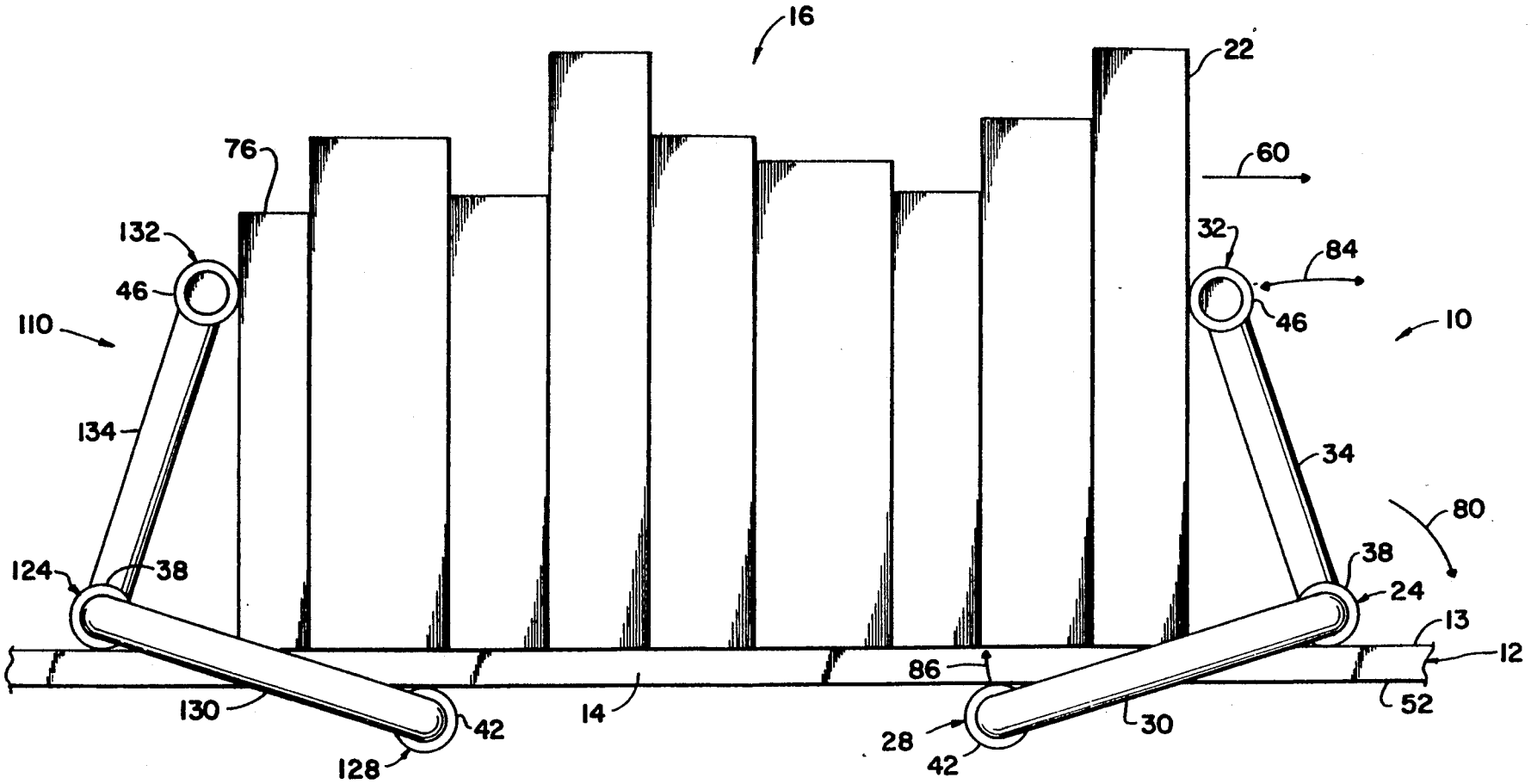
FIG. 4 is a front elevational view of a pair of lefthand and righthand bookends, according to this invention, mounted to a bookshelf and supporting respective ends of a row of books on the bookshelf.

Each of the rod segments is arranged perpendicularly to each adjacent rod segment. Therefore, intermediate rod segment 30 is perpendicular to rod segments 36 and 40, and intermediate rod segment 34 is likewise perpendicular to rod segments 36 and 44. As best illustrated in FIG. 3, rod segments 36, 40 and 44 and, accordingly, respective engagement portions 24, 28 and 32 are arranged parallel to one another. Moreover, segments 36, 40 and 44 have generally equal lengths. As best shown in FIG. 4, intermediate rod segments 30 and 34, which are connected to opposite ends of rod segment 36, are disposed generally perpendicularly to one another and may be of equal lengths, although in alternative embodiments (e.g. for very tall or short books or where the shelf is relatively thick or thin) these intermediate segments may have unequal lengths.

Rod member 23 is formed into its serpentine shape by various acceptable manufacturing techniques. For example, if the rod is composed of metals or metal alloys, an appropriate rod bending machine may be employed. If the rod member is composed of plastic, an appropriate mold may be utilized.

Bookend 10 is operably engaged with the row of books 16 on shelf 12 in the manner shown in FIGS. 1 and 3. The bookend is mounted to the bookshelf in the direction of arrow 47 so that shelf engaging section 18 engages the shelf 12 and bookstop section 20 engages book 22. More particularly, first engagement portion 24 extends transversely across and engages the upper surface 13 of bookshelf 12 adjacent row 16. Engagement portion 28 engages lower surface 52, FIG. 3, of bookshelf 12 underneath the row of books 16. The sleeves 38 and 42 engage the upper and lower surfaces 13 and 52, respectively and prevent the bookend from slipping along the shelf. Rod segment 30 extends across the forward edge 14 of bookshelf 12 and limits movement of bookend 10 in the direction of arrow 47. The bookend is properly positioned along the shelf so that portion 32 is supported above the shelf by segment 34 with sleeve 46 engaging the outer cover of book 22. Portion 32 extends transversely across the book in a generally forward direction. As a result, the row of books 16 is held securely in place and is prevented from sliding in the direction of arrow 60, FIGS. 1 and 4.

As shown in FIG. 4, a pair of bookends 10 and 110 are employed for supporting the righthand and lefthand ends, respectively, of a row of books 16. Righthand bookend 10 operates precisely in the manner described above. First engagement portion 24, second engagement portion 28 and intermediate rod segment 30 form a shelf engaging section that engages the upper and lower surfaces 13 and 52 of shelf 12. Third engagement portion 32 is held against the outer cover of end book 22 by intermediate segment 34.

Lefthand bookend 110 is constructed analogously to righthand bookend 10 but is configured differently so that the lefthand end of row 16 is engaged and supported. In particular, bookend 110 includes elongate engagement portions 124, 128 and 132, each having a respective slip resistent sleeve. Engagement portion 124 is engaged with the upper surface 13 and engagement portion 128 extends transversely across the lower surface 52 of shelf 12 underneath the row of books 16. Intermediate segment 130 extends across forward edge 14 of shelf 12 to interconnect portions 124 and 128. Intermediate segment 134 supports engagement portion 132 above the shelf against the books.

Other than being differently configured to engage the lefthand and righthand ends of row 16, the bookends 10 and 110 function analogously. In either position, the bookend provides a number of advantages. Sleeves 38 and 42 grip the upper and lower surfaces 13 and 52 of the shelf so that the bookends resist sliding along the shelf. The sleeves also help to prevent damage to the upper and lower surfaces of the shelf. Sleeve 46 minimizes damage to the book that is engaged by the upper portion of the bookend.

The generally perpendicular configuration of the bookends 10 and 110, which is best shown in FIG. 4, enhances the secure support that is provided to a stack of books. As the pressure exerted by a row of books on a bookend increases, that bookend grips the stack of books more securely. For example, force exerted on bookend 10 in the direction of arrow 60, FIG. 4, causes the bookend to pivot about portion 24 in the direction of arrow 80. This urges portion 28 in the direction of arrow 86 against the lower surface 52 of shelf 12. As a result, an improved tightened grip is provided on the end of the row of books. Such advantageous support is not provided by known bookends, which do not employ such a perpendicular configuration.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A bookend for a book shelf having top and bottom surfaces and a forward edge, said top surface supporting a row of books in an upright condition with the bound edges of said books facing forwardly, said bookend comprising:

a shelf engaging section that includes an elongate first engagement portion for engaging said top surface of said bookshelf adjacent to said row of books, an elongate second engagement portion spaced horizontally and vertically from said elongate first engagement portion for engaging said bottom surface of said bookshelf underneath said row of books, and a first intermediate portion that extends across said forward edge if said bookshelf for interconnecting respective first ends of said first and second engagement portions, said first and second engagement portions having respective distal second ends that are separated by an opening for receiving said bookshelf therethrough to allow said shelf engaging section to be mounted onto and removed from said bookshelf in a generally transverse direction; and a book stop section that is attached to and extends upwardly from said shelf engaging section for engaging the book at the end of said row of books.

2. The bookend of claim 1 in which said book stop section includes a third engagement portion that engages the book at the end of said row and a second intermediate portion that interconnects said first and third engagement portions and supports said third engagement portion above said bookshelf.

3. The bookend of claim 2 in which said first, second and third engagement portions include respective first, second and third rod segments, said first intermediate portion includes a fourth rod segment that integrally interconnects one end of said first rod segment and said second rod segment, and said second intermediate portion includes a fifth rod segment that integrally interconnects the other end of said first rod segment and said third rod segment.

4. The bookend of claim 3 in which said first engagement portion includes a slip resistent sleeve mounted on said first rod segment for defining an outer surface of said first engagement portion.

5. The bookend of claim 3 in which said second engagement portion includes a slip-resistent sleeve mounted on said second rod segment for defining an outer surface of said second engagement portion.

6. The bookend of claim 3 in which said third engagement portion includes a slip-resistent sleeve mounted on said third rod segment for defining an outer surface of said third engagement portion.

7. The bookend of claim 3 in which each said rod segment forms a right angle with each other said rod segment to which it is connected.

8. The bookend of claim 3 in which said first, second and third rod segments are disposed generally parallel to one another.

9. The bookend of claim 3 in which said fourth and fifth rod segments are disposed generally perpendicular to one another.

10. The bookend of claim 1 in which said shelf engaging section is disposed generally in a first plane and said book stop section is disposed generally in a second plane that is generally perpendicular to said first plane.

11. The bookend of claim 3 in which said first, second and third rod segments have generally equal lengths.

12. The bookend of claim 3 in which said first, second and fourth rod segments are disposed generally in a first plane and said third and fifth rod segments are disposed generally in a second plane that is generally perpendicular to said first plane.

13. A bookend for an elongate bookshelf having top and bottom surfaces and a forward edge, said top surface supporting a row of books in an upright condition with the bound edges of said books facing forwardly, said bookend comprising a first elongate segment for engaging and extending transversely across said top surface of said bookshelf;

a second elongate segment spaced horizontally and vertically from said elongate first engagement portion for engaging and extending transversely across said bottom surface of said bookshelf;

a third elongate segment that extends across and engages the cover of a book at the end of said row;

a fourth elongate segment that extends across said forward edge in said bookshelf for interconnecting said first and second segments; and a fifth elongate segment that interconnects said first and third segments and supports said third segment above said

14. The bookend of claim 13 in which said elongate segments include respective rod segments that are integrally interconnected in an end to end arrangement.

15. The bookend of claim 14 in which at least one of said first, second and third elongate segments includes a slip-resistent sleeve mounted on its respective rod segment for defining an outer surface of said elongate segment to respectively engage said upper and lower surfaces of said bookshelf and said book at the end of said row of books, respectively.

16. The bookend of claim 14 in which each said rod segment forms a right angle with each other said rod segment to which it is connected.

17. The bookend of claim 14 in which said first, second and third rod segments have generally equal lengths.

18. The bookend of claim 15 in which said first, second and fourth rod segments are disposed generally in a first plane and said third and fifth rod segments are disposed generally in a second plane that is generally perpendicular to said first plane.

19. The bookend of claim 1 in which said shelf engaging section includes a generally U-shaped configuration.

20. The bookend of claim 13 in which said first, second and fourth elongate segments have a generally U-shaped configuration.

* * * * *